US007705822B2

(12) United States Patent
Harada

(10) Patent No.: US 7,705,822 B2
(45) Date of Patent: Apr. 27, 2010

(54) LIQUID CRYSTAL DISPLAY

(75) Inventor: Kenji Harada, Fukaya (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 1260 days.

(21) Appl. No.: 11/225,057

(22) Filed: Sep. 14, 2005

(65) Prior Publication Data

US 2006/0061540 A1 Mar. 23, 2006

(30) Foreign Application Priority Data

Sep. 17, 2004 (JP) ..... 2004-271278

(51) Int. Cl.
*G09G 3/36* (2006.01)

(52) U.S. Cl. ..... 345/103; 345/100

(58) Field of Classification Search ..... 345/100, 345/103, 204; 348/556
See application file for complete search history.

(56) References Cited

U.S. PATENT DOCUMENTS 6,583,779 B1 * 6/2003 Ushirono ..... 345/100
2002/0008685 A1 * 1/2002 Ban et al. ..... 345/92

OTHER PUBLICATIONS

U.S. Appl. No. 12/342,751, filed Dec. 23, 2008, Harada, et al.

* cited by examiner

*Primary Examiner*—Amare Mengistu
*Assistant Examiner*—Yuk Chow
(74) *Attorney, Agent, or Firm*—Oblon, Spivak, McClelland, Maier & Neustadt, L.L.P.

(57) ABSTRACT

A liquid crystal display 1 displays an image of 16:9 aspect ratio by sequentially driving scan lines Y(1) to Y(30) and capacitor lines CL(1) to CL(30), in synchronization with this, sequentially driving scan lines Y(211) to Y(240) and capacitor lines CL(211) to CL(240), and thereafter, sequentially driving scan lines Y(31) to Y(210) and capacitor lines CL(31) to CL(210).

7 Claims, 9 Drawing Sheets

LIQUID CRYSTAL DISPLAY

CROSS-REFERENCE TO RELATED APPLICATION

This application is based upon and claims the benefit of priority from the prior Japanese Patent Application No. 2004-271278, filed on Sep. 17, 2004. The entire contents of which are incorporated herein by reference.

BACKGROUND OF THE INVENTION

1. Field of the Invention

The present invention relates to a liquid crystal display that needs no high frequencies to drive marginal display areas, has a simple structure, consumes little power, and achieves high response.

2. Description of Related Art

Although an NTSC system employing an aspect ratio of 4:3 is a standard television system, the development of a wide-vision system employing an aspect ratio of 16:9 has expanded the production of video software complying therewith, to allow people to enjoy video programs with more sense of realism.

There is a requirement for displays having an aspect ratio of 4:3 to cope with video programs having an aspect ratio of 16:9. For this, liquid crystal television sets and video cameras supporting the wide-vision mode have been developed.

FIG. 1 shows a display having an aspect ratio of 4:3 and supporting an aspect ratio of 16:9. Receiving a video signal of 16:9 aspect ratio, the display of FIG. 1 sets top and bottom marginal areas on a screen of 4:3 aspect ratio. Between the top and bottom marginal areas, a central area having an aspect ratio of 16:9 is secured to display an image of 16:9 aspect ratio. Without the top and bottom marginal areas, an image of 16:9 aspect ratio will be vertically expanded on the screen of FIG. 1.

According to the related art of FIG. 1, a frequency for driving the top and bottom marginal areas must be higher than a frequency used to display an image of 4:3 aspect ratio. The reason of this will be explained based on a liquid crystal display (hereinafter referred to as "LCD") having 240 scan lines and employing the NTSC system. Driving a screen of 4:3 aspect ratio of this LCD needs 15.3 ms, which is obtained by multiplying a horizontal scan period of 63.6 μs by the number of horizontal scan lines, 240. Driving a central area of 16:9 aspect ratio secured in the screen also needs 15.3 ms.

Top and bottom marginal areas defined in the screen each include 30 scan lines. Driving the top and bottom marginal areas at the driving frequency for the 4:3 aspect ratio takes a time of 3.8 ms (=horizontal scan period 63.6 μs×60). Then, the total time for driving the top and bottom marginal areas and the central area will be 19.1 ms (=15.3 ms+3.8 ms) that exceeds one field period of 16.7 ms. Accordingly, the top and bottom marginal areas must be driven at a higher frequency.

In more detail, the 60 scan lines that form the top and bottom marginal areas must be driven within 1.4 ms (=16.7 ms−15.3 ms), and therefore, a horizontal scan period for the marginal areas must be 23.3 μs (=1.4 ms/60). Namely, when displaying an image of 16:9 aspect ratio, the driving frequency for the marginal areas must be about 2.7 times as fast as the driving frequency for the 4:3 aspect ratio. This is true not only for the NTSC system but also for a PAL system.

Increasing a driving frequency may lead to a shortage of charge in each pixel electrode of the LCD. If each pixel electrode is insufficiently charged, a black color displayed in the top and bottom marginal areas will differ in brightness from a black color displayed in the central area.

To cope with this problem, Patent Document 1 (Japanese Unexamined Patent Application Publication No. H05-199482) discloses an LCD that equalizes the potential of scan electrodes with the potential of signal electrodes in the top and bottom marginal areas. Patent Document 2 (Japanese Unexamined Patent Application Publication No. H08-314421) discloses an LCD that writes black information in scan lines of the top and bottom marginal areas.

Patent Document 3 (Japanese Unexamined Patent Application Publication No. 2001-051643) discloses an LCD 2 shown in FIGS. 2 to 4 in which FIG. 2 is a circuit diagram showing a liquid crystal panel of the LCD 2, FIG. 3 is a view showing the liquid crystal panel and related components, and FIG. 4 is a view showing voltage waveforms in the LCD 2.

In FIG. 2, a signal line driver 11 receives a video signal whose polarity is inverted every horizontal scan period (H). A horizontal scan circuit 10 generates sampling pulses according to a control signal. In response to the sampling pulses, the signal line driver 11 sequentially supplies the video signal to signal lines X.

The LCD 2 sets an upper marginal area in a screen having an aspect ratio of 4:3 so that the remaining lower area of the screen may have an aspect ratio of 16:9 to display an image of 16:9 aspect ratio.

A wide-view control signal is at a low voltage in a period of driving the lower area, as shown in FIG. 4. In the period of driving the lower area, a switch shown in FIG. 3 is connected to a precharge pulse generator to supply a precharge pulse signal to the liquid crystal panel. In the period of driving the lower area, a precharge control signal alternates ON and OFF states as shown in FIG. 4. In the LCD 2 of FIG. 2, precharge switches PSW are set to an ON state during the ON period of the precharge control signal, to supply the precharge pulse signal to the signal lines X. When the precharge switches PSW are turned off, the signal line driver 11 supplies a video signal to the signal lines X. During a period in which the precharge pulse signal or the video signal is supplied to the signal lines X, a scan line driver 13 drives scan lines Y. Through pixel transistors Q that are made conductive with a corresponding one of the scan lines Y, the precharge pulse or the video signal is supplied to pixel electrodes P connected to the pixel transistors Q. As a result, an electric field whose strength is dependent on the amplitude of the signal is applied to a liquid crystal layer related to each of the pixel electrodes P, and the liquid crystal layer emits light whose quantity is dependent on the strength of the electric field.

The wide-view control signal is at a high voltage in a period for driving the marginal area, as shown in FIG. 4. In the period for driving the marginal area, the switch shown in FIG. 3 is connected to a wide-view pulse generator to supply a wide-view pulse signal to the liquid crystal panel. At this time, the signal line driver 11 supplies no video signal to the signal lines X, and the wide-view pulse signal is supplied through the precharge switches PSW, which are ON due to the wide-view control signal, to the signal lines X. During the period in which the wide-view pulse signal is supplied to the signal lines X, the scan line driver 13 drives the scan lines Y. Through pixel transistors Q that are made conductive with a corresponding one of the scan lines Y, the wide-view pulse signal is supplied to pixel electrodes P connected to the pixel transistors Q. Then, each corresponding liquid crystal layer emits light whose intensity is dependent on the amplitude of the signal.

To realize the two aspect ratios of 4:3 and 16:9, the LCDs disclosed in the Patent Documents 1 and 2 need additional driving systems, memories, scan converters, and the like. The LCDs of these related arts, therefore, are complicated and large and consume large power. The LCD disclosed in the Patent Document 3 must increase the amplitude of a wide-view pulse signal larger than that of a precharge pulse signal. Also, this related art must increase a current value of the wide-view pulse signal because the wide aspect ratio increases the number of pixels in a horizontal direction. This results in increasing the power consumption of a video signal processing IC shown in FIG. 3 and thus the power consumption of the LCD.

Among LCDs used for a variety of applications, those used for EVFs (electronic view finders) of liquid crystal television sets and video cameras and those used for displaying video data recorded in DVDs (digital versatile disks) require improved response to display high-quality images.

The response of an LCD may be improved by, for example, superimposing an over-drive voltage on a video signal. This, however, requires devices and line memories for computing the over-drive voltage, thereby increasing the complexity and cost of the LCD.

SUMMARY OF THE INVENTION

An object of the present invention is to provide an LCD that needs no high frequencies to drive marginal display areas, has a simple structure, consumes little power, and achieves high response.

In order to accomplish the object, a first aspect of the present invention provides an LCD having an array substrate that includes signal lines, scan lines intersecting the signal lines, pixel transistors arranged at intersections of the signal and scan lines, respectively, each pixel transistor becoming conductive when driven through the corresponding scan line, pixel electrodes arranged at the intersections of the signal and scan lines, respectively, each pixel electrode being written with a video signal supplied through the corresponding signal line when the corresponding pixel transistor becomes conductive, and capacitor lines formed along the scan lines, respectively, to provide an auxiliary capacitor for each of the pixel electrodes. The LCD also has a liquid crystal layer, a counter substrate opposing the array substrate with the liquid crystal layer interposed between them, a signal line driver for supplying video signals to the signal lines, a scan line driver for sequentially driving the scan lines, a capacitor line driver for sequentially driving the capacitor lines, a display area to display an image by driving the scan lines and capacitor lines. The display area may be divided into a central area and top and bottom marginal areas that are on the top and bottom sides of the central area. In this case, the scan lines and capacitor lines in the top and bottom marginal areas are synchronously driven.

According to the first aspect, the LCD synchronously drives the scan lines and capacitor lines in the top and bottom marginal areas, to eliminate the need of high driving frequencies. The first aspect is structurally simple to reduce power consumption and realizes high response with the capacitor lines.

According to a second aspect of the present invention, the capacitor line driver alternately applies two compensating voltages one at a time to each of the capacitor lines at predetermined timing in each field period. The second aspect equalizes positive and negative effective voltages applied to liquid crystals and realizes a uniform distribution of electric field over the entire liquid crystal layer. This results in preventing intensity unevenness, flicker, and burn-in on the LCD.

According to a third aspect of the present invention, the scan line driver has shift registers for driving the scan lines, respectively, and the capacitor line driver has unit circuits for driving the capacitor lines, respectively. The unit circuits, except some of them, are each driven by a predetermined one of the shift registers. The some unit circuits are those that are lastly driven in the central area when the marginal areas are driven at first and then the central area. The scan line driver also has shift registers for driving the some unit circuits. The third aspect drives the capacitor lines that are lastly driven in the central area like the other capacitor lines, to realize a uniform distribution of electric field over the entire liquid crystal layer. This results in preventing intensity unevenness, flicker, and burn-in on the LCD.

A fourth aspect of the present invention drives the marginal areas before the central area by alternating the polarities of the scan lines from line to line. According to the fourth aspect, the LCD further includes a unit for differing the polarity of a scan line that is lastly driven in the central area from the polarity of a line that is firstly driven in the marginal areas and is adjacent to the line lastly driven in the central area. The fourth aspect realizes a uniform AC electric field distribution over the liquid crystal layer including the line that is lastly driven in the central area and the line that is firstly driven in the marginal areas and is adjacent to the lastly driven line. This results in preventing intensity unevenness, flicker, and burn-in on the LCD.

A fifth aspect of the present invention forms the signal line driver, scan line driver, and capacitor line driver on the array substrate in the same process that forms the pixel transistors on the array substrate, thereby reducing the number of manufacturing processes of the LCD. The fifth aspect can reduce the size of an IC that includes the signal line driver, scan line driver, and capacitor line driver, the number of parts such as terminals, and the dimensions of a peripheral area that must be prepared for mounting the IC.

DETAILED DESCRIPTION OF EMBODIMENTS

LCDs according to the embodiments of the present invention will be explained with reference to the accompanying drawings.

First Embodiment

Figure 1:
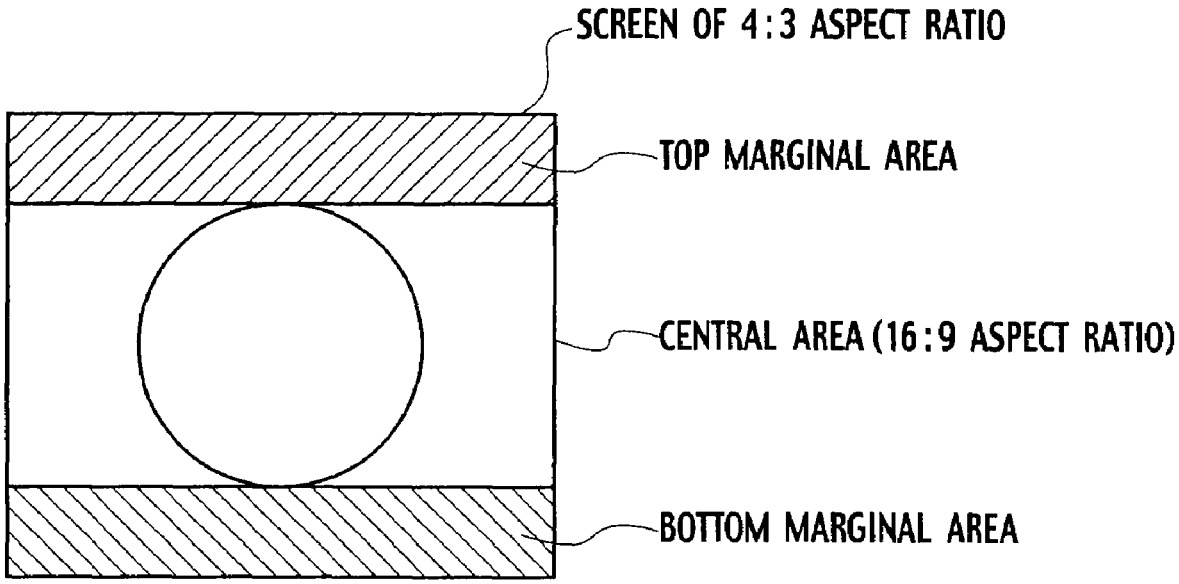
FIG. 1 Related Art
FIG. 1 is a view showing a screen having an aspect ratio of 4:3 in which an image of 16:9 aspect ratio is displayed.
Figure 2:
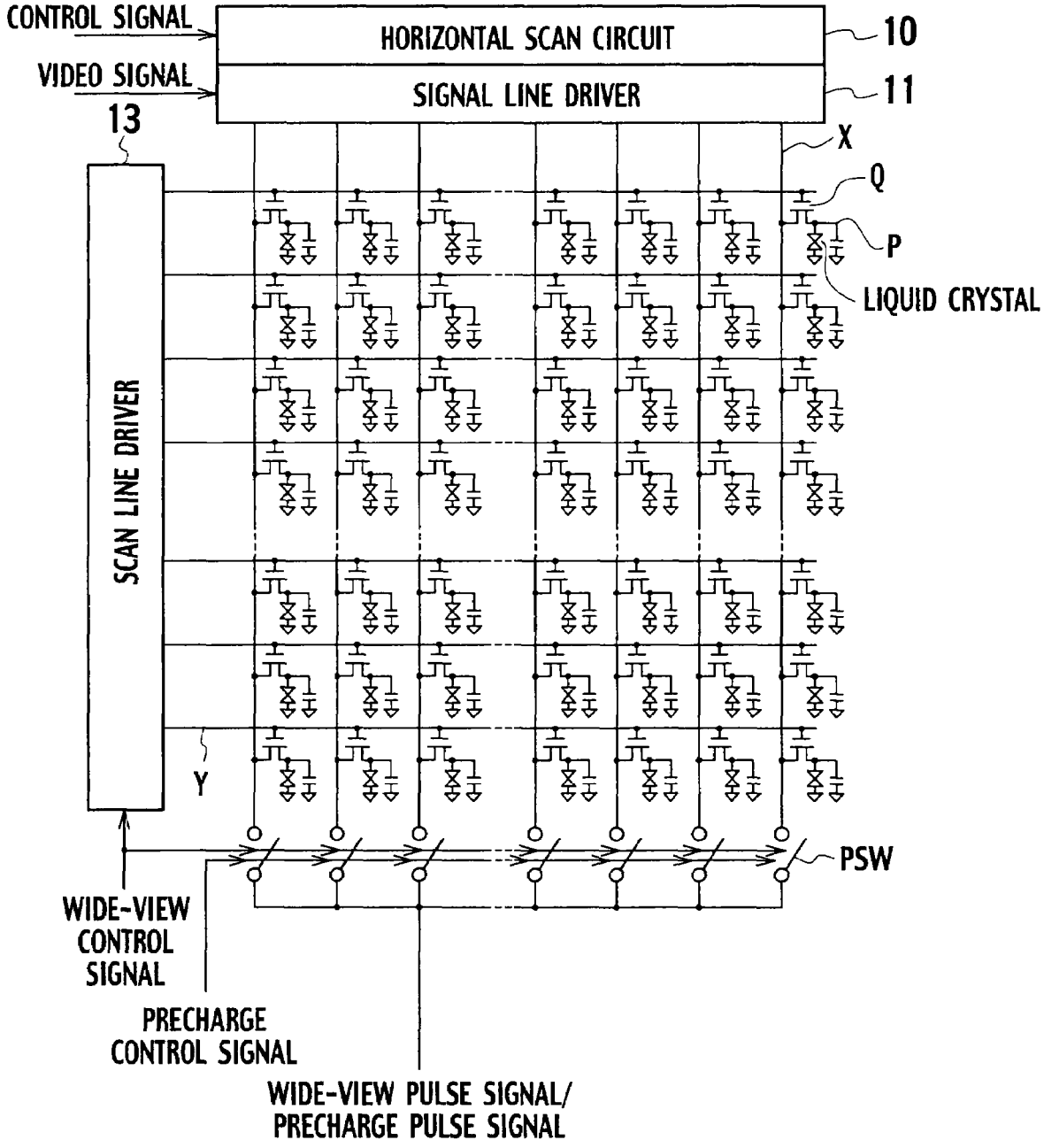
FIG. 2 Related Art
FIG. 2 is a circuit diagram showing a liquid crystal panel of an LCD 2 according to a related art.
Figure 3:
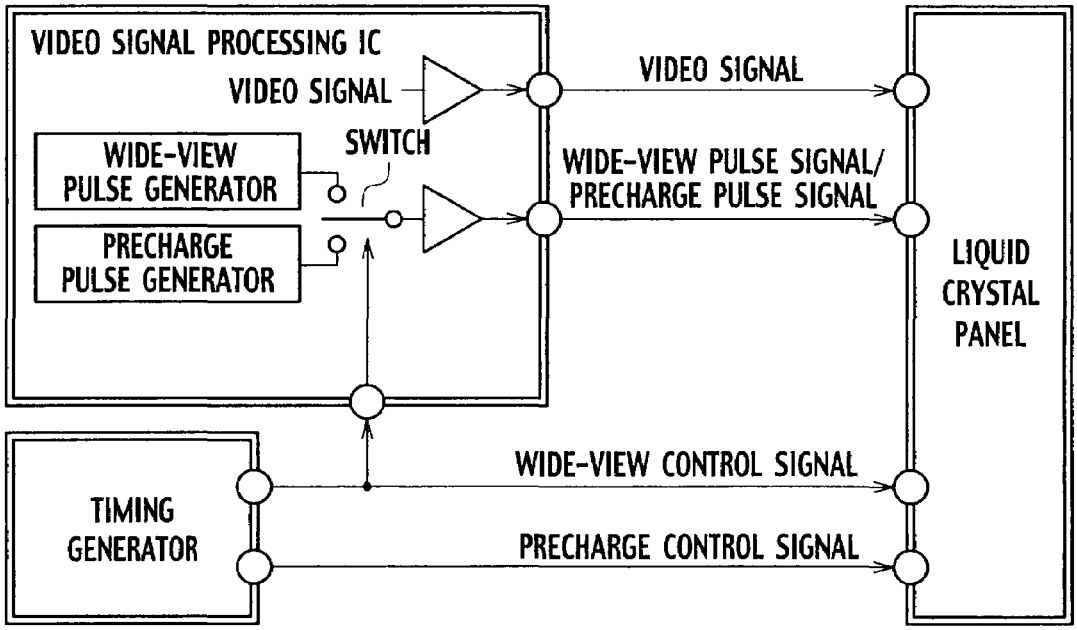
FIG. 3 Related Art
FIG. 3 is a circuit diagram showing the liquid crystal panel of FIG. 2 and circuits related thereto.
Figure 4:
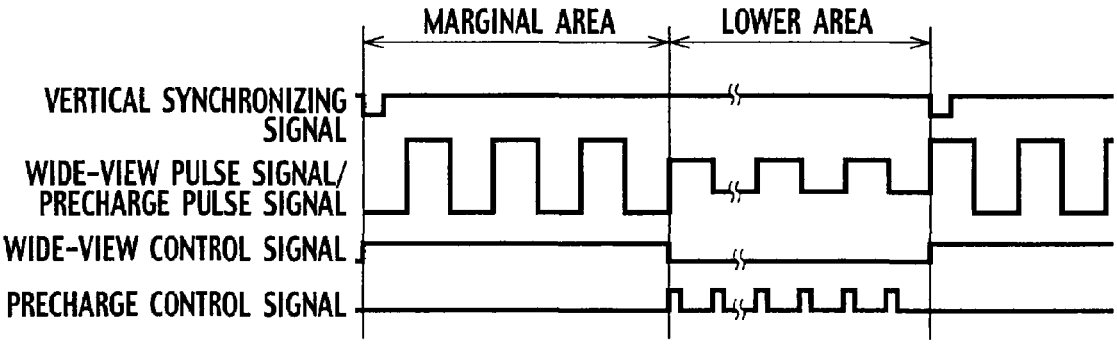
FIG. 4 Related Art
FIG. 4 is a view showing voltage waveforms in the LCD 2 of FIG. 2.
Figure 5:
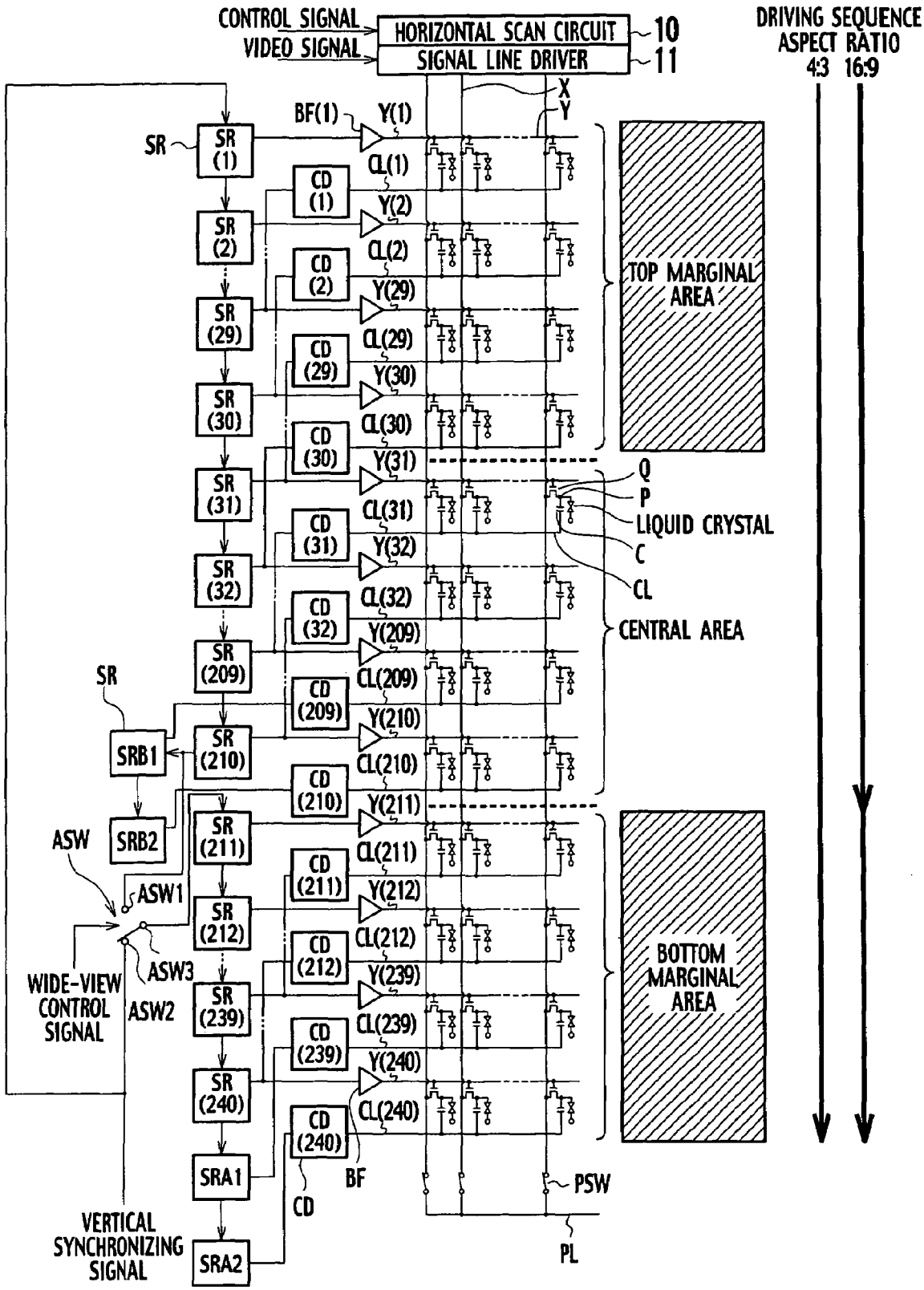
FIG. 5 is a block diagram showing an LCD 1 according to a first embodiment of the present invention and a driving sequence thereof.

An LCD 1 according to the first embodiment of the present invention will be explained. FIG. 5 is a block diagram showing the LCD 1 according to the first embodiment and a driving sequence thereof.

The LCD 1 has an array substrate (not shown) on which signal lines X and scan lines Y intersect each other, a liquid crystal layer (liquid crystal elements), and a counter substrate (not shown) that opposes the array substrate with the liquid crystal layer interposed between them. The LCD 1 may have a backlight unit (not shown) serving as a light source arranged on the back of the array substrate. The LCD 1 may have a color filter arranged on the counter substrate.

On the array substrate, the signal lines X and scan lines Y intersect each other. At each intersection of the signal lines X and scan lines Y, there are a pixel transistor Q and a pixel electrode P. The pixel transistor Q becomes conductive when the corresponding scan line Y is driven. Through the conductive pixel transistor Q, the pixel electrode P receives a video signal from the corresponding signal line X. A capacitor line CL is formed along each scan line Y, to provide an auxiliary capacitor C for the pixel electrode P.

The pixel transistor Q is, for example, a thin film transistor (TFT). According to the embodiment, the gate, source, and drain of the pixel transistor Q are connected to the corresponding scan line Y, signal line X, and pixel electrode P, respectively.

The number of lines in the LCD 1 is optional if the number of the scan lines Y is equal to the number of the capacitor lines CL. According to the embodiment, the number of lines in the LCD 1 is 240, and the lines are referred to as line 1, line 2, and the like.

The LCD 1 includes a signal line drive circuit consisting of a horizontal scan circuit 10 and a signal line driver 11. The signal line driver 11 receives a video signal whose polarity is inverted every horizontal scan period (H). The signal line driver 11 has switches (not shown) connected to the signal lines X, respectively. The horizontal scan circuit 10 receives a control signal and generates sampling pulses. According to the sampling pulses, the signal line driver 11 sequentially samples a video signal. Namely, according to the sampling pulses, the signal line driver 11 sequentially turns on the switches and supplies the video signal to each signal line X during the ON period of the switch corresponding to the signal line X.

Each scan line Y is provided with a shift register SR and a buffer BF, to drive the scan line Y. The shift registers SR and buffers BF form a scan line driver. When a vertical synchronizing signal given to the LCD 1 drives the line 1, the shift register SR(1) (the number "1" between the parentheses represents the corresponding line number) supplies a high voltage Vgh through the buffer BF(1) to the scan line Y(1), thereby selecting the scan line Y(1). Similarly, the shift registers SR and buffers BF up to the line 240 are sequentially driven at the intervals of a horizontal scan period, to sequentially drive the scan lines Y.

Each capacitor line CL is provided with a unit circuit CD to drive the capacitor line CL. The unit circuits CD form a capacitor line driver. Each unit circuit CD alternately applies two compensating voltages one at a time to the corresponding capacitor line at predetermined timing in each field period (equal to 16.7 μs according to the NTSC system). According to the embodiment, the "predetermined timing" is a rise of the output of every second shift register SR.

The LCD 1 of the embodiment employs a line inverting technique. Namely, in a given field period, the LCD 1 inverts the polarities of lines from line to line, or every horizontal scan period. More precisely, the LCD 1 differs the polarity of pixel electrodes P of a given line with respect to the polarity of the counter electrode from the polarity of pixel electrodes P of the next line with respect to the polarity of the counter electrode.

Each unit circuit CD is driven by a shift register SR that is located in the second line counted from the line in which the unit circuit CD in question is present. For example, the unit circuit CD(1) is driven by the shift register SR(3), the unit circuit CD(2) is driven by the shift register SR(4), and so on. Shift registers that drive the unit circuits CD(209) and CD(210) will be explained later.

In the LCD 1, a shift register SRA1 is arranged after the line of the shift register SR(240), only to drive the unit circuit CD(239). After the shift register SRA1, a shift register SRA2 is arranged only to drive the unit circuit CD(240).

In a normal case of displaying an image of 4:3 aspect ratio, the LCD 1 forms a display area with the lines 1 to 240 and sequentially drives the lines from the line 1 to the line 240. To realize a wide view of 16:9 aspect ratio, or a letter-box view, the LCD 1 forms a top marginal area with the lines 1 to 30, a bottom marginal area with the lines 211 to 240, and a central area with the lines 31 to 210. The central area is used to display a significant image of 16:9 aspect ratio. The LCD 1 drives the lines of the top marginal area in an ascending order, and in synchronization with this, drives the lines of the bottom marginal area in an ascending order. Thereafter, the LCD 1 drives the lines of the central area in an ascending order.

When displaying an image of 16:9 aspect ratio, the shift registers SR(211) and SR(212) are used to drive the scan lines Y(211) and Y(212), respectively. In this case, the shift registers SR(211) and SR(212) operate at the start of a given field period. On the other hand, the unit circuits CD(209) and CD(210) operate at the end of the same field period.

Accordingly, if the shift registers SR(211) and SR(212) are configured to drive the unit circuits CD(209) and CD(210), respectively, a time difference between the drive timing of the scan line Y and the drive timing of the capacitor line CL in each of the lines 209 and 210 will differ from that in any other line. To solve the problem of the time difference, the embodiment arranges a shift register SRB1 after the shift register SR(210) separately from the shift register SR(211), only to drive the unit circuit CD(209). Also, the embodiment arranges a shift register SRB2 after the shift register SRB1 separately from the shift register SR(212), only to drive the unit circuit CD(210).

An aspect ratio switch ASW switches a signal supply source for operating the shift register SR(211) from one to another. The aspect ratio switch ASW has a terminal ASW1 connected to a signal line for operating the shift register SRB1 from the shift register SR(210), a terminal ASW2 connected to a signal line for supplying a vertical synchronizing signal, and a terminal ASW3 connected to a signal line for operating the shift register SR(211). In the normal case of displaying an image of 4:3 aspect ratio, the terminals ASW1 and ASW3 are connected to each other so that the shift register SR(210) may drive the shift register SR(211). If the LCD 1 receives a wide-view control signal to display an image of 16:9 aspect ratio, the terminals ASW2 and ASW3 are connected to each other so that a vertical synchronizing signal may drive the shift register SR(211).

Each signal line X is connected to a common precharge line PL through a precharge switch PSW. The common line PL is connected to a counter electrode (not shown) that is a single electrode formed on the counter substrate and facing all of the pixel electrodes P. The counter electrode receives, for example, a DC voltage.

(Realizing 4:3 Aspect Ratio According to the First Embodiment)

A normal operation, i.e., an operation of displaying an image of 4:3 aspect ratio according to the first embodiment will be explained with reference to FIGS. 5 and 6.

Figure 6:
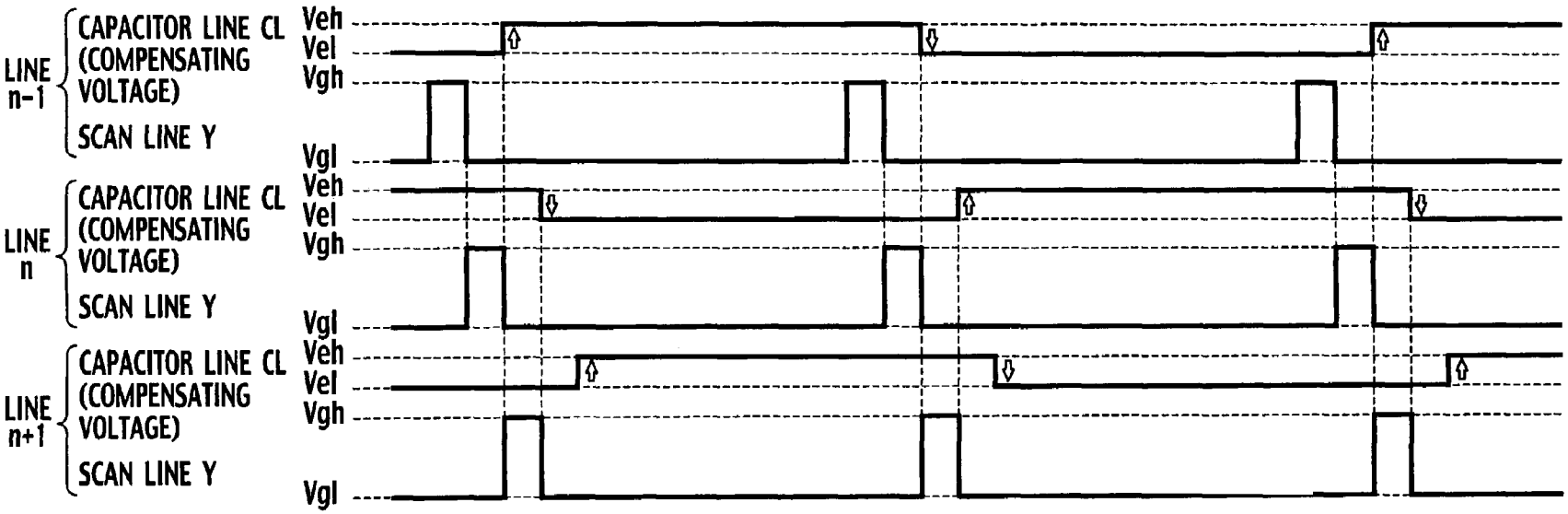
FIG. 6 is a view showing voltage waveforms on scan lines Y and capacitor lines CL in the LCD 1 according to the first embodiment.

FIG. 6 is a view showing voltage waveforms on the scan lines Y and capacitor lines CL in the LCD 1. More precisely, FIG. 6 shows voltage waveforms on the scan lines Y(n−1), Y(n), and Y(n+1) and compensating voltage waveforms on the capacitor lines CL(n−1), CL(n), and CL(n+1).

In the normal operation, the LCD 1 does not receive the wide-view control signal shown in FIG. 5, and the terminals ASW1 and ASW3 of the aspect ratio switch ASW are connected to each other. When a vertical synchronizing signal is supplied, the shift register SR(1) operates in response to the signal. Like the voltage waveform on the scan line Y(n−1) shown in FIG. 6, the shift register SR(1) sets the scan line Y(1) to a high voltage Vgh to make the pixel transistors Q connected to the scan line Y(1) conductive. This results in supplying a video signal through the pixel transistors Q to the corresponding pixel electrodes P.

The capacitor line CL(1) receives a compensating voltage corresponding to the polarity of the video signal. A compensating voltage residing on the capacitor line CL(1) just before the scan line Y(1) is set to the high voltage Vgh is maintained during a period in which the scan line Y(1) is kept at the high voltage Vgh. Namely, like the voltage waveform of the compensating voltage on the capacitor line CL(n−1) shown in FIG. 6, a low compensating voltage Vel residing on the capacitor line CL(1) just before the scan line Y(1) is set to the high voltage Vgh is kept as it is during a period in which the scan line Y(1) is kept at the high voltage Vgh.

If a horizontal scan period HT1 (for example, about 63.6 μs that is unchanged through the normal mode of 4:3 aspect ratio) passes after the scan line Y(l) has been set to the high voltage Vgh, the scan line Y(1) is set to a low voltage Vgl and the shift register SR(1) drives the shift register SR(2). Like the voltage waveform of the scan line Y(n) shown in FIG. 6, the scan line Y(2) is set at the high voltage Vgh during the operation of the shift register SR(2), to make the pixel transistors Q connected to the scan line Y(2) conductive.

A compensating voltage residing on the capacitor line CL(2) just before the scan line Y(2) is set to the high voltage Vgh is maintained during a period in which the scan line Y(2) is kept at the high voltage Vgh. Namely, like the voltage waveform of the compensating voltage on the capacitor line CL(n) shown in FIG. 6, a high compensating voltage Veh residing on the capacitor line CL(2) just before the scan line Y(2) is set to the high voltage Vgh is kept as it is during a period in which the scan line Y(2) is kept at the high voltage Vgh.

If the horizontal scan period HT1 passes after the scan line Y(2) has been set to the high voltage Vgh, the scan line Y(2) is set to the low voltage Vgl and the shift register SR(2) drives the shift register SR(3). Like the voltage waveform of the scan line Y(n+1) shown in FIG. 6, the scan line Y(3) is set at the high voltage Vgh during the operation of the shift register SR(3), to make the pixel transistors Q connected to the scan line Y(3) conductive.

A compensating voltage residing on the capacitor line CL(3) just before the scan line Y(3) is set to the high voltage Vgh is maintained during a period in which the scan line Y(3) is kept at the high voltage Vgh. Namely, like the voltage waveform of the compensating voltage on the capacitor line CL(n+1) shown in FIG. 6, the low compensating voltage Vel residing on the capacitor line CL(3) just before the scan line Y(3) is set to the high voltage Vgh is kept as it is during a period in which the scan line Y(3) is kept at the high voltage Vgh.

If the horizontal scan period HT1 passes after the scan line Y(2) has been set to the high voltage Vgh, the unit circuit CD(1) operates at a rise of the output of the shift register SR(3), i.e., the voltage on the scan line Y(3), to switch the compensating voltage on the capacitor line CL(1) connected to the unit circuit CD(1) to another.

These operations are repeated after the scan line Y(3). Namely, if the horizontal scan period HT1 passes after a given scan line Y has been set to the high voltage Vgh, a corresponding shift register drives the next shift register. A compensating voltage residing on a corresponding capacitor line CL just before the scan line Y is set to the high voltage Vgh is kept as it is during a period in which the scan line Y is kept at the high voltage Vgh. At a rise of the output of each of the shift registers SR that follow the shift register SR(4), a corresponding one of the unit circuits CD that follow the unit circuit CD(2) operates.

If the horizontal scan period HT1 passes after the scan line Y(210) has been set to the high voltage Vgh, the scan line Y(210) is set to the low voltage Vgl and the shift register SR(210) drives the shift registers SR(211) and SRB1.

The scan line Y(211) is set at the high voltage Vgh during the operation of the shift register SR(211), to make the pixel transistors Q connected to the scan line Y(211) conductive.

A compensating voltage residing on the capacitor line CL(211) just before the scan line Y(211) is set to the high voltage Vgh is maintained during a period in which the scan line Y(211) is kept at the high voltage Vgh.

If the horizontal scan period HT1 passes after the scan line Y(210) has been set to the high voltage Vgh, the unit circuit CD(209) operates at a rise of the output of the shift register SRB1 to switch a compensating voltage on the capacitor line CL(209) connected to the unit circuit CD(209) to another. Namely, like any other capacitor line CL, the compensating voltage on the capacitor line CL(209) can be switched to another at a rise of the output of the second next shift register SR.

If the horizontal scan period HT1 passes after the scan line Y(211) has been set to the high voltage Vgh, the scan line Y(211) is set to the low voltage Vgl and the shift registers SR(211) and SRB1 drive the shift registers SR(212) and SRB2, respectively.

The scan line Y(212) is set at the high voltage Vgh during the operation of the shift register SR(212), to make the pixel transistors Q connected to the scan line Y(212) conductive.

A compensating voltage residing on the capacitor line CL(212) just before the scan line Y(212) is set to the high voltage Vgh is maintained during a period in which the scan line Y(212) is kept at the high voltage Vgh.

If the horizontal scan period HT1 passes after the scan line Y(211) has been set to the high voltage Vgh, the unit circuit CD(210) operates at a rise of the output of the shift register SRB2 to switch a compensating voltage on the capacitor line CL(210) connected to the unit circuit CD(210) to another.

Namely, like any other capacitor line CL, the compensating voltage on the capacitor line CL(210) can be switched to another at a rise of the output of the second next shift register SR.

These operations are repeated after the scan line Y(212). Namely, if the horizontal scan period HT1 passes after a given scan line Y has been set to the high voltage Vgh, a corresponding shift register drives the next shift register. A compensating voltage residing on a corresponding capacitor line CL just before the scan line Y is set to the high voltage Vgh is kept as it is during a period in which the scan line Y is kept at the high voltage Vgh. At a rise of the output of each of the shift registers SR that follow the shift register SR(213), a corresponding one of the unit circuits CD that follow the unit circuit CD(211) operates.

If the horizontal scan period HT1 passes after the scan line Y(240) has been set to the high voltage Vgh, the scan line Y(240) is set to the low voltage Vgl and the shift register SR(240) drives the shift register SRA1. At a rise of the output of the shift register SRA1, the unit circuit CD(239) operates to switch a compensating voltage on the capacitor line CL(239) connected to the unit circuit CD(239) to another.

If the horizontal scan period HT1 passes after the operation of the shift register SRA1, the shift register SRA1 drives the shift register SRA2. At a rise of the output of the shift register SRA2, the unit circuit CD(240) operates to switch a compensating voltage on the capacitor line CL(240) connected to the unit circuit CD(240) to another.

In this way, in every field period, the LCD 1 sequentially drives the scan lines and capacitor lines from the scan line Y(1) and capacitor line CL(1) to the scan line Y(240) and capacitor line CL(240), to display an image of 4:3 aspect ratio.

Figure 7:
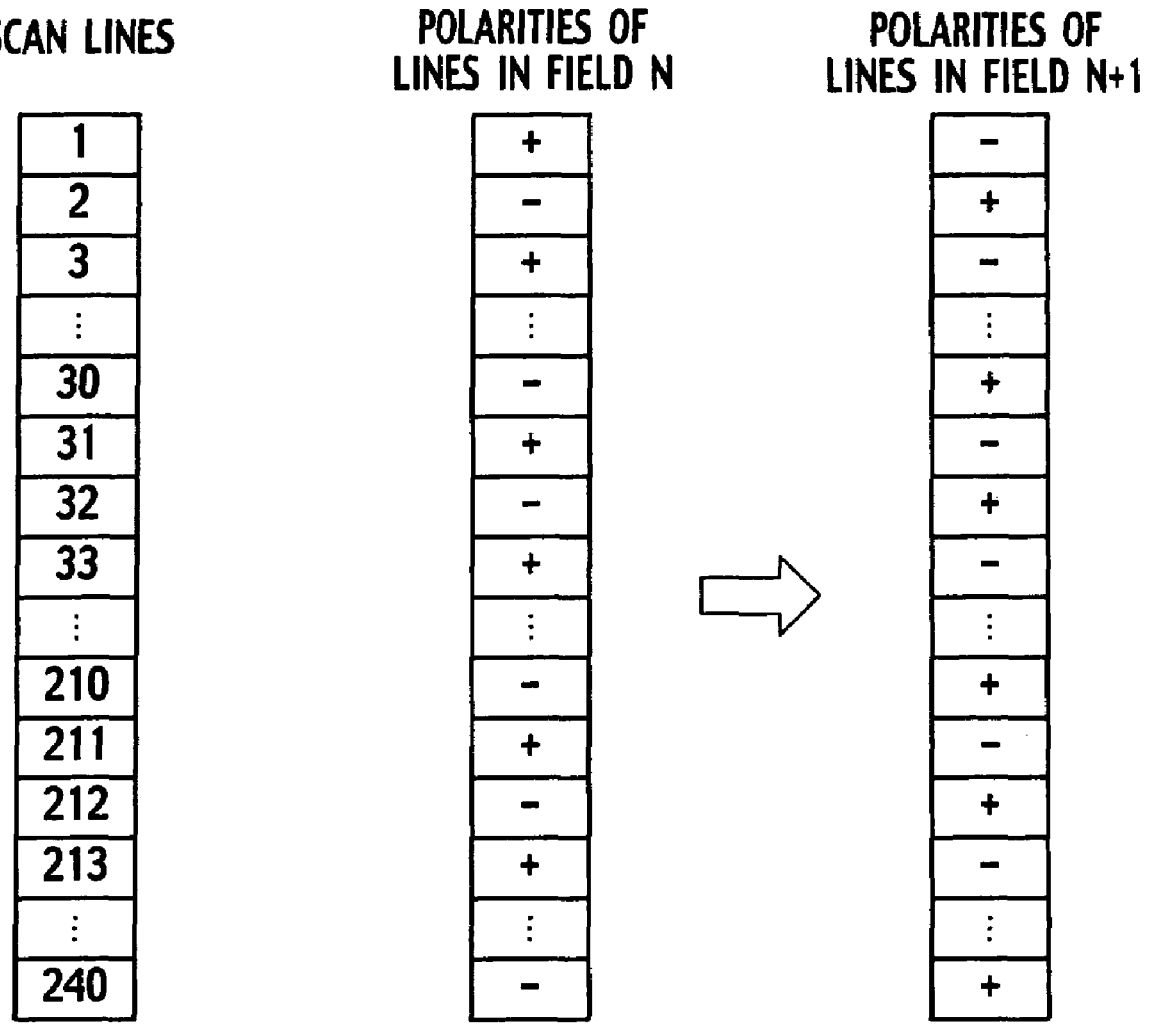
FIG. 7 is a model showing the polarities of lines in the LCD 1 according to the first embodiment when displaying an image of 4:3 aspect ratio.

FIG. 7 is a model showing the polarities of lines in the LCD 1 when displaying an image of 4:3 aspect ratio. In a field N, the polarity of a given scan line is opposite to the polarity of a preceding scan line that is driven a horizontal scan period HT1 before the given scan line.

In the next field N+1, the LCD 1 operates like in the field N. However, like the voltage waveform of the scan line Y(n−1) shown in FIG. 6, a compensating voltage on each capacitor line CL maintained from a switching point in the preceding field is switched to an opposite direction in synchronization with a rise of the output of the second next shift register SR, i.e., a rise of a voltage on the second next scan line Y.

As is apparent from comparison between the polarity of a given line (for example, the line Y(1)) in the field N of FIG. 7 and the polarity of the given line (the line Y(1)) in the field N+1, the polarity of each line is inverted field by field.

(Realizing 16:9 Aspect Ratio According to the First Embodiment)

Displaying an image of 16:9 aspect ratio with the LCD 1 will be explained with reference to FIG. 5.

(Operation in Marginal Areas)

Receiving a wide-view control signal, the LCD 1 connects the terminals ASW2 and ASW3 of the aspect ratio switch ASW to each other. When a vertical synchronizing signal is supplied, the shift registers SR(1) and SR(211) operate in response to the signal. When displaying an image of 16:9 aspect ratio, the vertical synchronizing signal is given earlier than when displaying an image of 4:3 aspect ratio by a time necessary for driving the marginal areas.

The operating shift registers SR(1) and SR(211) set the scan lines Y(1) and Y(211) to the high voltage Vgh to make the pixel transistors Q connected to the scan lines Y(1) and Y(211) conductive.

Compensating voltages residing on the capacitor lines CL(1) and CL(211) just before the scan lines Y(1) and Y(211) are set to the high voltage Vgh are maintained during a period in which the scan lines Y(1) and Y(211) are at the high voltage Vgh.

If a horizontal scan period HT11 (for example, about 46.7 μs that is unchanged through the marginal areas when displaying an image of 16:9 aspect ratio) passes after the scan lines Y(1) and Y(211) have been set to the high voltage Vgh, the scan lines Y(1) and Y(211) are set to the low voltage Vgl and the shift registers SR(1) and SR(211) drive the shift registers SR(2) and SR(212).

During the operation of the shift registers SR(2) and SR(212), the scan lines Y(2) and Y(212) are set at the high voltage Vgh to make the pixel transistors Q connected to the scan lines Y(2) and Y(212) conductive.

Compensating voltages residing on the capacitor lines CL(2) and CL(212) just before the scan lines Y(2) and Y(212) are set to the high voltage Vgh are maintained during a period in which the scan lines Y(2) and Y(212) are at the high voltage Vgh.

If the horizontal scan period HT11 passes after the scan lines Y(2) and Y(212) have been set to the high voltage Vgh, the scan lines Y(2) and Y(212) are set to the low voltage Vgl and the shift registers SR(2) and SR(212) drive the shift registers SR(3) and SR(213).

During the operation of the shift registers SR(3) and SR(213), the scan lines Y(3) and Y(213) are set at the high voltage Vgh to make the pixel transistors Q connected to the scan lines Y(3) and Y(213) conductive.

Compensating voltages residing on the capacitor lines CL(3) and CL(213) just before the scan lines Y(3) and Y(213) are set to the high voltage Vgh are maintained during a period in which the scan lines Y(3) and Y(213) are at the high voltage Vgh.

If the horizontal scan period HT11 passes after the scan lines Y(2) and Y(212) have been set to the high voltage Vgh, the unit circuits CD(1) and CD(211) operate at rises of the outputs of the shift registers SR(3) and SR(213), i.e., rises of the voltages on the scan lines Y(3) and Y(213), to switch compensating voltages on the capacitor lines CL(1) and CL(211) connected to the unit circuits CD(1) and CD(211) to others.

These operations are repeated after the scan lines Y(3) and Y(213). Namely, if the horizontal scan period HT11 passes after given scan lines Y have been set to the high voltage Vgh, corresponding shift registers drive the next shift registers. Compensating voltages residing on corresponding capacitor lines CL just before the scan lines Y are set to the high voltage Vgh are kept as they are during the period in which the scan lines Y are at the high voltage Vgh. At rises of the outputs of shift registers SR that follow the shift registers SR(4) and SR(214), corresponding unit circuits CD that follow the unit circuits CD(2) and CD(212) operate.

If the horizontal scan period HT11 passes after the scan lines Y(30) and Y(240) have been set to the high voltage Vgh, the scan lines Y(30) and Y(240) are set to the low voltage Vgl and the shift registers SR(30) and SR(240) drive the shift registers SR(31) and SRA1. At rises of the outputs of the shift registers SR(31) and SRA1, the unit circuits CD(29) and CD(239) operate to switch compensating voltages on the capacitor lines CL(29) and CL(239) connected to the unit circuits CD(29) and CD(239) to others.

If a horizontal scan period HT12 (the details thereof will be explained later) passes after the operation of the shift registers SR(31) and SRA1, the shift registers SR(31) and SRA1 drive the shirt registers SR(32) and SRA2, respectively. At rises of the outputs of the shift registers SR(32) and SRA2, the unit circuits CD(30) and CD(240) operate to switch compensating voltages on the capacitor lines CL(30) and CL(240) connected to the unit circuits CD(30) and CD(240) to others. In this way, the LCD 1 drives the marginal areas. At this time, the amplitudes of voltages applied to liquid crystals in the marginal areas are equalized to display a single color in the marginal areas.

(Operation in Central Area)

As mentioned above, the scan line Y(31) is set at the high voltage Vgh during the operation of the shift register SR(31) to make the pixel transistors Q connected to the scan line Y(31) conductive. A compensating voltage residing on the capacitor line CL(31) just before the scan line Y(31) is set to the high voltage Vgh is maintained during a period in which the scan line Y(31) is kept at the high voltage Vgh. The scan line Y(32) is set at the high voltage Vgh during the operation of the shift register SR(32) to make the pixel transistors Q connected to the scan line Y(32) conductive. A compensating voltage residing on the capacitor line CL(32) just before the scan line Y(32) is set to the high voltage Vgh is maintained during a period in which the scan line Y(32) is kept at the high voltage Vgh.

If the horizontal scan period HT12 passes after the operation of the shift registers SR(31) and SRA1, the shift registers SR(31) and SRA1 drive the shift registers SR(32) and SRA2, respectively. The horizontal scan period HT12 is used for the central area when displaying an image of 16:9 aspect ratio. Similar to displaying an image of 4:3 aspect ratio, a time for completely displaying an image in the central area is 15.3 ms.

In this way, if the horizontal scan period HT12 passes after a given scan line Y that follows the scan line Y(32) has been set to the high voltage Vgh, a corresponding shift register drives the next shift register. A compensating voltage residing on a corresponding capacitor line CL just before the scan line Y is set to the high voltage Vgh is kept as it is during a period in which the scan line Y is kept at the high voltage Vgh. At a rise of the output of each of the shift registers SR that follow the shift register SR(33), a corresponding one of the unit circuits CD that follow the unit circuit CD(31) operates.

If the horizontal scan period HT12 passes after the scan line Y(210) has been set to the high voltage Vgh, the scan line Y(210) is set to the low voltage Vgl and the shift register SR(210) drives the shift register SRB1. At a rise of the output of the shift register SRB1, the unit circuit CD(209) operates to switch a compensating voltage on the capacitor line CL(209) connected to the unit circuit CL(209) to another. Namely, like any other capacitor line CL, the compensating voltage on the capacitor line CL(209) can be switched to another at a rise of the output of the second next shift register SR.

If the horizontal scan period HT12 passes after the operation of the shift register SRB1, the shift register SRB1 drives the shift register SRB2. At a rise of the output of the shift register SRB2, the unit circuit CD(210) operates to switch a compensating voltage on the capacitor line CL(210) connected to the unit circuit CD(210) to another. Like any other capacitor line CL, the compensating voltage on the capacitor line CL(210) can be switched to another at a rise of the output of the second next shift register SR.

In this way, in every field period, the LCD 1 sequentially drives the scan lines and capacitor lines from the scan line Y(1) and capacitor line CL(1) to the scan line Y(30) and capacitor line CL(30). In synchronization with this, the LCD 1 sequentially drives the scan lines and capacitor lines from the scan line Y(211) and capacitor line CL(211) to the scan line Y(240) and capacitor line CL(240). Thereafter, the LCD 1 sequentially drives the scan lines and capacitor lines from the scan line Y(31) and capacitor line CL(31) to the scan line Y(210) and capacitor line CL(210), to display an image of 16:9 aspect ratio.

In the next field period that starts after a vertical blanking period of several milliseconds, the LCD 1 operates like in the preceding field period. A compensating voltage on each capacitor line CL maintained from a switching point in the preceding field period is switched to another at a rise of the output of the corresponding second next shift register SR.

Figure 8:
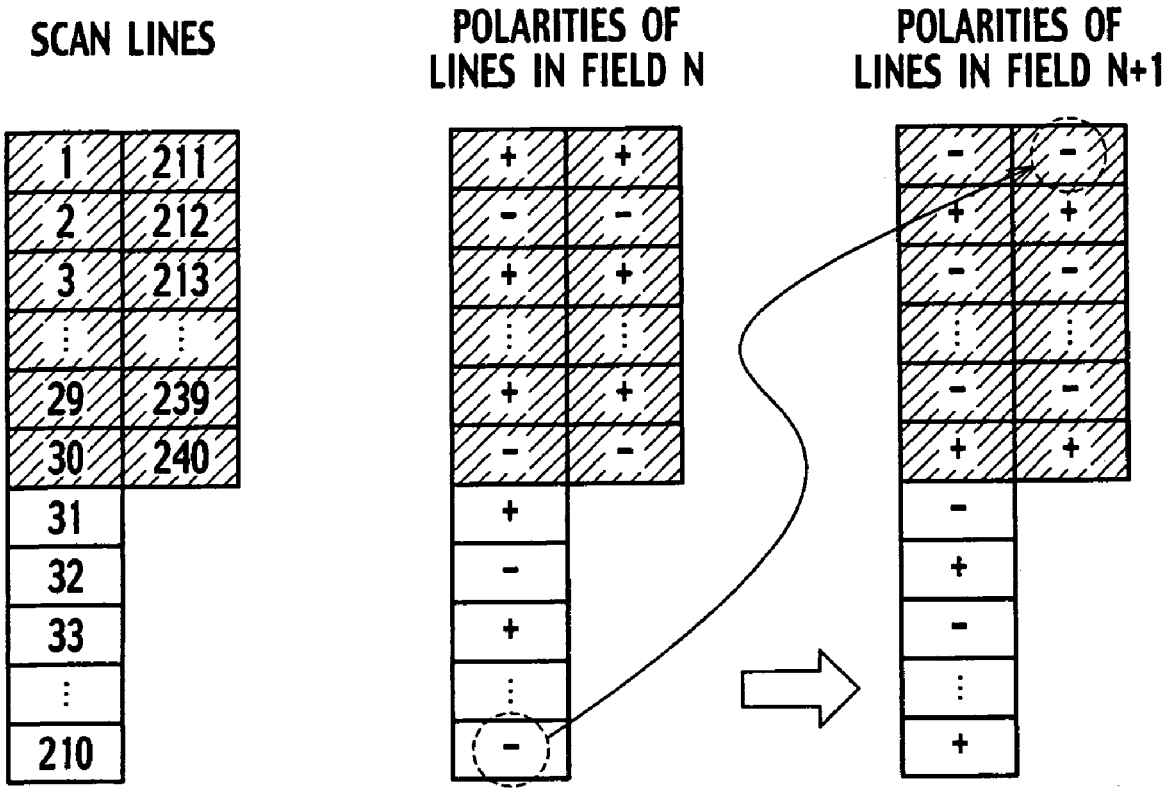
FIG. 8 is a model showing the polarities of lines in the LCD 1 according to the first embodiment when displaying an image of 16:9 aspect ratio.

FIG. 8 is a model showing the polarities of lines in the LCD 1 when displaying an image of 16:9 aspect ratio. As is apparent from comparison between the polarities of adjacent lines in a field N, the polarities of the scan lines are inverted from line to line. As is apparent from comparison between the polarity of a given line in the field N and the polarity of the given line in the field N+1, the polarity of each line is inverted field by field.

A total drive time required by the LCD 1 when displaying an image of 16:9 aspect ratio will be explained. According to the embodiment, the LCD 1 forms the top and bottom marginal areas each with 30 scan lines and synchronously drives these marginal areas with the horizontal scan period HT11 that is about 46.7 μs. A drive time for the marginal areas, therefore, is about 46.7 μs×30=about 1.4 ms. This results in suppressing a frequency for driving the marginal areas to about 1.36 times as large as a frequency for driving a display screen of 4:3 aspect ratio. Since the time necessary for driving the marginal areas is about 1.4 ms, the total drive time for the top and bottom marginal areas and the central area is 16.7 ms (1.4 ms+15.3 ms). Namely, the LCD 1 according to the embodiment can drive the top and bottom marginal areas and the central area without exceeding a field period (=16.7 ms).

In this way, the LCD 1 according to the embodiment can display an image of 4:3 aspect ratio and an image of 16:9 aspect ratio. In each case, the LCD 1 writes a video signal in pixel electrodes, thereafter turns off pixel transistors, and applies a voltage Vlc(+) to liquid crystals if the polarity of the pixel electrodes is positive relative to the counter electrode, or a voltage Vlc(−) to liquid crystals if the polarity of the pixel electrodes is negative relative to the counter electrode. These voltages Vlc(+) and Vlc(−) are expressed as follows:

$$Vlc(+)=Vs-V\mathrm{com}+\{Cst\times(Veh-Vel)-Cgd\times(Vgh-Vgl)\}/(Cst+Clc+Cgd) \quad (1)$$

$$Vlc(-)=Vs-V\mathrm{com}-\{Cst\times(Veh-Vel)+Cgd\times(Vgh-Vgl)\}/(Cst+Clc+Cgd) \quad (2)$$

where Vs is the voltage of the video signal, Vcom is the voltage of the counter electrode, Veh is the high compensating voltage (on the capacitor line), Vel is the low compensating voltage (on the capacitor line), Vgh is the high gate voltage (on the scan line), Vgl is the low gate voltage (on the scan line), Cgd is a gate-drain capacitance, Cst is the capacitance of the auxiliary capacitor C, and Clc is the capacitance of liquid crystals.

The LCD 1 properly sets the compensating voltages Veh and Vel to equalize the effective values of the voltages Vlc(+) and Vlc(−) for AC driving. Namely, no DC voltage is applied to liquid crystals, thereby preventing the flicker and burn-in of the LCD 1.

The LCD 1 switches the compensating voltages applied to the capacitor lines CL according to the polarity of a video signal. If the dynamic behavior of a capacitive coupling voltage due to the dielectric constant anisotropy of liquid crystal material changes a displayed image, the LCD 1 automatically applies an overdrive voltage in a direction to amplify the change, thereby realizing high-speed response and improving visibility of moving images. The LCD 1 superimposes the compensating voltage on the voltage of each pixel electrode to allow the amplitude of a video signal to be reduced and minimize power consumption. Reducing the amplitude of a video signal results in minimizing potential variations of the capacitor lines and counter electrode, thereby preventing crosstalk.

The LCD 1 turns on the precharge switches PSW in a vertical blanking period, to precharge the pixel electrodes P at the potential of the counter electrode before writing a video signal into the pixel electrodes P. The precharge is effective to suppress variations in the potential of the signal lines at the time of writing a video signal, reduce a charge/discharge current, prevent unevenness in a displayed image, and improve the quality of the displayed image. Since the compensating voltages are switched from one to another, a DC voltage may be applied to the counter electrode and this DC voltage may be used for precharging the pixel electrodes P. This results in simplifying the precharging circuitry. There is no need of AC-driving the counter electrode having a large capacitive load, and therefore, the LCD 1 consumes little power.

As explained above, the LCD 1 according to this embodiment needs no high frequency for driving the marginal areas. Due to this, the LCD 1 is capable of sufficiently charging the pixel electrodes to secure the quality of displayed images. The LCD 1 needs no special driving systems, memories, scan converters, and the like. Due to this, the LCD 1 has a simple structure to reduce power consumption. The capacitor lines CL of the LCD 1 are effective to improve response.

The LCD 1 alternately applies two compensating voltages one at a time to each capacitor line at predetermined timing in each field, to equalize the effective values of positive and negative voltages applied to the liquid crystals. This leads to equalizing an electric field distribution over the liquid crystal layer, thereby preventing intensity unevenness, flicker, and burn-in on the LCD 1.

The LCD 1 drives all unit circuits CD except the unit circuits CD(209) and CD(210), which are lastly driven in the central area, with corresponding ones of the shift registers SR for driving the scan lines Y. To drive the unit circuits CD(209) and CD(210), the LCD 1 has the dedicated shift registers SRB1 and SRB2. As a result, the LCD 1 can drive the capacitor lines CL(209) and CL(210) like the remaining capacitor lines. Namely, like the remaining capacitor lines, compensating voltages applied to the capacitor lines CL(209) and CL(210) can be switched to others at rises of the outputs of the second next shift registers SR, respectively. As a result, effective voltages applied to liquid crystals in the lines 209 and 210 can be equalized with those applied to liquid crystals in the other lines. Due to this, a distribution of electric field over entire liquid crystals including those in the lines 209 and 210 becomes uniform to prevent intensity unevenness, flicker, and burn-in on the LCD.

The timing of switching a compensating voltage on a given capacitor line CL to another through a corresponding unit circuit CD is not always twice the horizontal scan period HT11 or HT12 after the voltage of a corresponding scan line has been set to the high voltage Vgh. The two compensating voltages may be alternately applied one at a time to each capacitor line at predetermined timing in each field. The timing of switching the two compensating voltages from one to another may be the horizontal scan period HT11 or HT12, or thrice the period HT11 or HT12, or quadruple the period HT11 or HT12, or the like after the voltage of a corresponding scan line has been set to the high voltage Vgh. In this case, one, three, or more shift registers (such as SRB1 and SRB2) for driving the unit circuits corresponding to the capacitor lines that are lastly driven in the central area must be arranged.

When displaying an image of 16:9 aspect ratio, the LCD 1 firstly drives the scan lines Y(1) and Y(211) in a given field period and lastly drives the scan line Y(210) that is adjacent to the scan line Y(211). If the polarity of the line 211 corresponding to the scan line Y(211) is positive (+), the polarity of the line 210 corresponding to the scan line Y(210) is negative (−) as shown in FIG. 8. Inverting the polarities of the adjacent lines is effective to prevent intensity unevenness in a displayed image. The polarity of each line is inverted field by field. Accordingly, in the next field after a vertical blanking period of several milliseconds, the polarity of the line 211 will be negative (−). In this case, the polarities of the adjacent lines 210 and 211 are not inverted relative to each other as shown in FIG. 8. This non-inverted state continues for a long time (about 13 ms) until the polarity of the line 210 is changed to positive (+). This may cause intensity unevenness in a displayed image.

Second Embodiment

Figure 9:
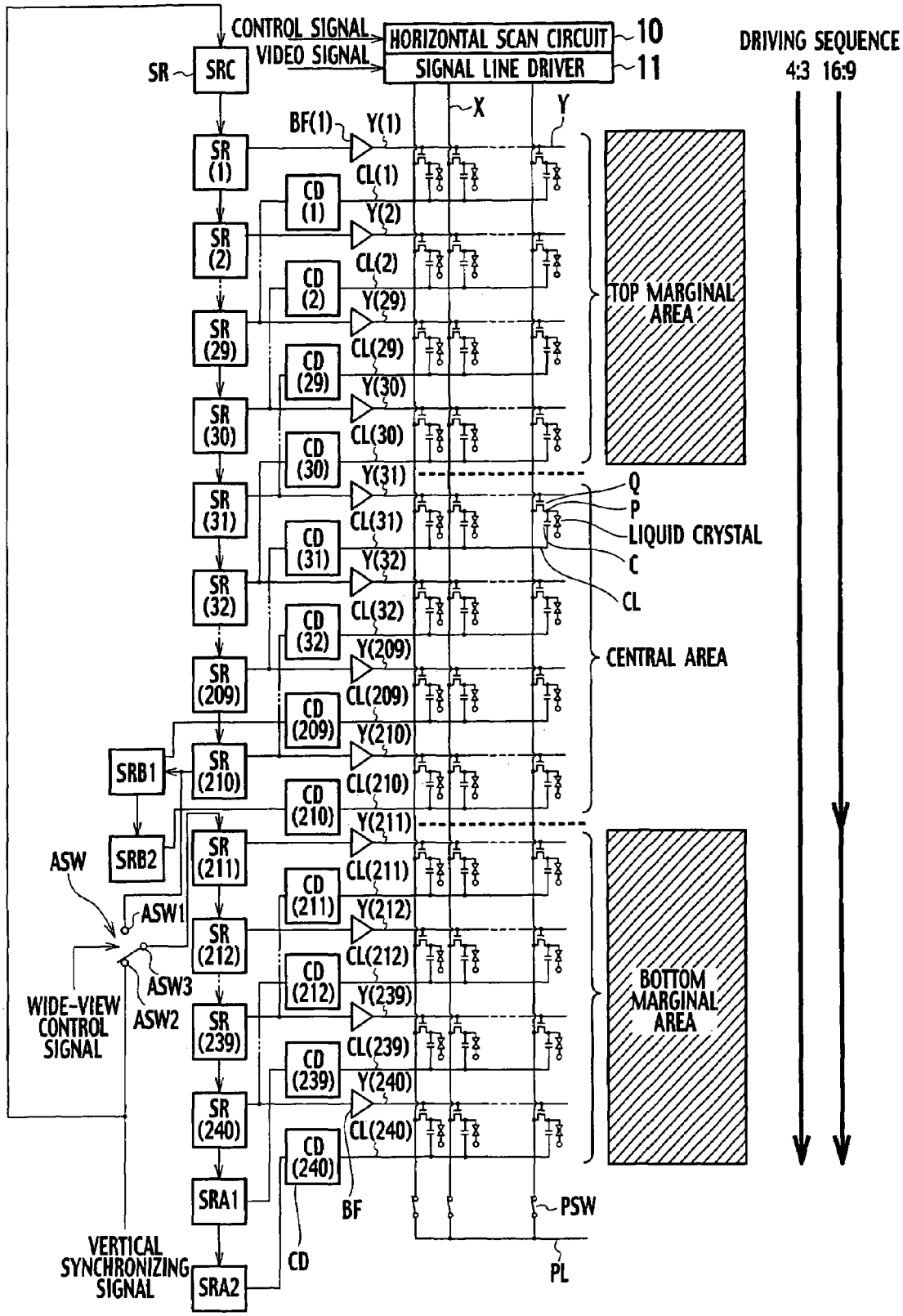
FIG. 9 is a circuit diagram showing an LCD 1A according to a second embodiment of the present invention and a driving sequence thereof.

FIG. 9 is a circuit diagram showing an LCD 1A according to the second embodiment of the present invention and a driving sequence thereof. The LCD 1A has a shift register SRC in addition to the LCD 1 of the first embodiment. A vertical synchronizing signal drives the shift register SRC, which drives a shift register SR(1). The shift register SR(1) drives a scan line Y(1). Namely, the second embodiment delays the driving of the scan line Y(1) by a horizontal scan period HT21 (for example, about 45.0 μs that is unchanged through marginal areas when displaying an image of 16:9 aspect ratio). Consequently, the driving of each scan line Y that follows is also delayed by the same horizontal scan period HT21. A rise of the output of a shift register SR(3) is also delayed by, for example, the horizontal scan period HT21. As a result, the operation of a unit circuit CD(1) is delayed by HT21 and each unit circuit that follows is also delayed by HT21.

When displaying an image of 4:3 aspect ratio, the LCD 1A conducts the same processes as those conducted by the LCD 1 of the first embodiment except that the second embodiment delays the scanning of each line by the horizontal scan period HT21. Accordingly, an explanation how to display an image of 4:3 according to the second embodiment is omitted. The LCD 1A contains the structure of the LCD 1, and therefore, can provide the effect of the LCD 1.

(Realizing 16:9 Aspect Ratio According to the Second Embodiment)

Displaying an image of 16:9 aspect ratio with the LCD 1A of the second embodiment will be explained with reference to FIG. 9.

(Operation in Marginal Areas)

Receiving a wide-view control signal, the LCD 1A connects terminals ASW2 and ASW3 of an aspect ratio switch ASW to each other. When a vertical synchronizing signal is supplied, the shift registers SRC and SR(211) operate in response to the signal.

The operating shift registers SRC and SR(211) set a scan line Y(211) to a high voltage Vgh to make pixel transistors Q connected to the scan line Y(211) conductive.

A compensating voltage residing on a capacitor line CL(211) just before the scan line Y(211) is set to the high voltage Vgh is maintained during a period in which the scan line Y(211) is kept at the high voltage Vgh.

If the horizontal scan period HT21 passes after the scan line Y(211) has been set to the high voltage Vgh, the scan line Y(211) is set to a low voltage Vgl and the shift registers SRC and SR(211) drive the shift registers SR(1) and SR(212).

During the operation of the shift registers SR(1) and SR(212), the scan lines Y(1) and Y(212) are set at the high voltage Vgh to make pixel transistors Q connected to the scan lines Y(1) and Y(212) conductive.

Compensating voltages residing on capacitor lines CL(1) and CL(212) just before the scan lines Y(1) and Y(212) are set to the high voltage Vgh are maintained during a period in which the scan lines Y(1) and Y(212) are at the high voltage Vgh.

If the horizontal scan period HT21 passes after the scan lines Y(1) and Y(212) have been set to the high voltage Vgh, the scan lines Y(1) and Y(212) are set to the low voltage Vgl and the shift registers SR(1) and SR(212) drive shift registers SR(2) and SR(213).

During the operation of the shift registers SR(2) and SR(213), scan lines Y(2) and Y(213) are set at the high voltage Vgh to make pixel transistors Q connected to the scan lines Y(2) and Y(213) conductive.

Compensating voltages residing on capacitor lines CL(2) and CL(213) just before the scan lines Y(2) and Y(213) are set to the high voltage Vgh are maintained during a period in which the scan lines Y(2) and Y(213) are at the high voltage Vgh.

If the horizontal scan period HT21 passes after the scan lines Y(1) and Y(212) have been set to the high voltage Vgh, unit circuits CD(2) and CD(211) operate at rises of the outputs of the shift registers SR(2) and SR(213), i.e., rises of the voltages on the scan lines Y(2) and Y(213), to switch compensating voltages on capacitor lines CL(2) and CL(211) connected to the unit circuits CD(2) and CD(211) to others.

These operations are repeated after the scan lines Y(2) and Y(213). Namely, if the horizontal scan period HT21 passes after given scan lines Y have been set to the high voltage Vgh, corresponding shift registers drive the next shift registers. Compensating voltages residing on corresponding capacitor lines CL just before the scan lines Y are set to the high voltage Vgh are kept as they are during a period in which the scan lines Y are at the high voltage Vgh. At rises of the outputs of shift registers SR that follow the shift registers SR(3) and SR(214), corresponding unit circuits CD that follow the unit circuits CD(1) and CD(212) operate.

If the horizontal scan period HT21 passes after scan lines Y(29) and Y(240) have been set to the high voltage Vgh, the scan lines Y(29) and Y(240) are set to the low voltage Vgl and shift registers SR(29) and SR(240) drive shift registers SR(30) and SRA1.

During the operation of the shift register SR(30), the scan line Y(30) is set at the high voltage Vgh to make pixel transistors Q connected to the scan line Y(30) conductive.

A compensating voltage residing on a capacitor line CL(30) just before the scan line Y(30) is set to the high voltage Vgh is maintained during a period in which the scan line Y(30) is kept at the high voltage Vgh.

If the horizontal scan period HT21 passes after the scan lines Y(29) and Y(240) have been set to the high voltage Vgh, unit circuits CD(28) and CD(239) operate at rises of the outputs of the shift registers SR(30) and SRA1 to switch compensating voltages on capacitor lines CL(28) and CL(239) connected to the unit circuits CD(28) and CD(239) to others.

If the horizontal scan period HT21 passes after the scan line Y(30) has been set to the high voltage Vgh, the scan line Y(30) is set to the low voltage Vgl and the shift registers SR(30) and SRA1 drive shift registers SR(31) and SRA2. At rises of the outputs of the shift registers SR(31) and SRA2, unit circuits CD(29) and CD(240) operate to switch compensating voltages on capacitor lines CL(29) and CL(240) connected to the unit circuits CD(29) and CD(240) to others.

If the horizontal scan period HT21 passes after the start of operation of the shift registers SR(31) and SRA2, the shift register SR(31) drives a shift register SR(32). At a rise of the output of the shift register SR(32), a unit circuit CD(30) operates to switch a compensating voltage on a capacitor line CL(30) connected to the unit circuit CD(30) to another.

In this way, the LCD 1A drives the marginal areas. The amplitudes of voltages applied to liquid crystals in the marginal areas are equalized to display a single color in the marginal areas.

(Operation in Central Area)

The operation of the LCD 1A in the central area when displaying an image of 16:9 aspect ratio is the same as that of the LCD 1 of the first embodiment except that the second embodiment delays the scanning of each line by the horizontal scan period HT21. Accordingly, an explanation of the operation of the LCD 1A in the central area is omitted.

In this way, in every field period, the LCD 1A sequentially drives the scan lines and capacitor lines from the scan line Y(1) and capacitor line CL(1) to the scan line Y(30) and capacitor line CL(30). In synchronization with this, the LCD 1A sequentially drives the scan lines and capacitor lines from the scan line Y(212) and capacitor line CL(212) to the scan line Y(240) and capacitor line CL(240). Thereafter, the LCD 1A sequentially drives the scan lines and capacitor lines from the scan line Y(31) and capacitor line CL(31) to the scan line Y(210) and capacitor line CL(210), to display an image of 16:9 aspect ratio.

A total drive time required by the LCD 1A when displaying an image of 16:9 aspect ratio will be explained.

The LCD 1A forms the top and bottom marginal areas each with 30 scan lines, delays the driving of the marginal areas by the horizontal scan period HT21 (=45.0 μs), and synchronously drives the marginal areas with the horizontal scan period HT21. A drive time for the marginal areas, therefore, is about 45.0 μs×31=about 1.4 ms. This results in suppressing a frequency for driving the marginal areas to about 1.41 times as large as a frequency for driving a display screen of 4:3 aspect ratio.

Since the time necessary for driving the marginal areas is about 1.4 ms, the total drive time for the top and bottom marginal areas and the central area is 16.7 ms (1.4 ms+15.3 ms). Namely, the LCD 1A according to the embodiment can drive the top and bottom marginal areas and the central area without exceeding a field period (=16.7 ms).

Figure 10:
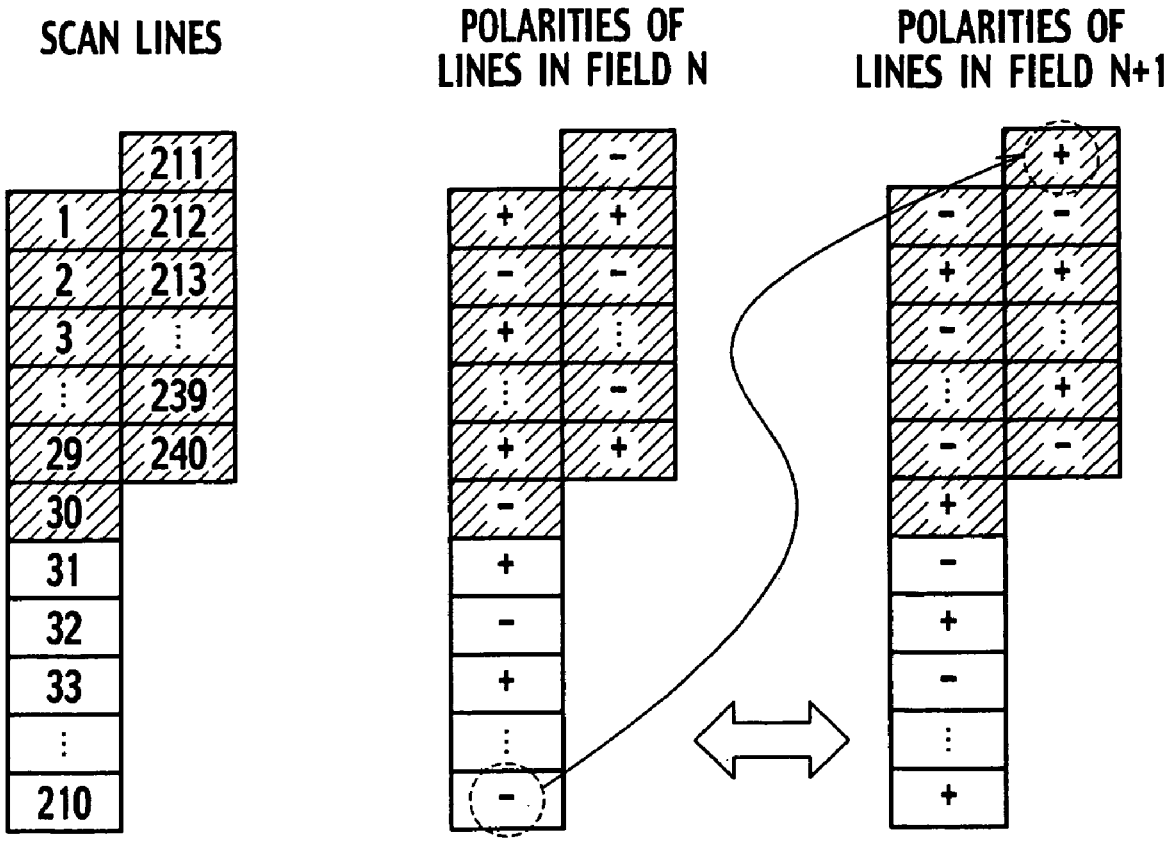
FIG. 10 is a model showing the polarities of lines in the LCD 1A according to the second embodiment when displaying an image of 16:9 aspect ratio.

FIG. 10 is a model showing the polarities of lines in the LCD 1A when displaying an image of 16:9 aspect ratio.

The LCD 1A has the shift register SRC, and therefore, the polarity of the line 210 is negative (−) if the polarity of the line 211 is negative (−).

In this case, the polarities of these adjacent lines are not inverted relative to each other. In the next field period after a vertical blanking period (several milliseconds), the polarity of the line 211 becomes positive (+), and therefore, the polarities of the adjacent lines 210 and 211 are inverted relative to each other as shown in FIG. 10. This arrangement of the second embodiment is particularly effective when the vertical blanking period is short, i.e., when a period between the completion of write in a given field and the start of write in the next field is short.

As explained above, the LCD 1A according to the second embodiment employs the shift register SRC that makes the polarity of the line 210 lastly driven in the central area different from the polarity of the line 211 firstly driven in the marginal areas, the line 211 being adjacent to the line 210. The LCD 1A realizes a uniform AC electric field distribution over the liquid crystal layer including these lines 210 and 211, to prevent the intensity unevenness, flicker, and burn-in of the LCD 1A that may be caused by the dielectric constant anisotropy of liquid crystal material.

According to a modification of the second embodiment, the shift register SRC may be operated in response to a vertical synchronizing signal if the vertical blanking period is short, and if the vertical blanking period is long, the shift register SR(1) may be operated in response to the vertical synchronizing signal. This modification also provides the effect of the second embodiment.

The LCDs 1 and 1A drive the lines in an ascending order. Without deteriorating the effects of the LCDs 1 and 1A, it is possible to make the lines drive them switchably in a descending order or in an ascending order.

In this case, the shift register SR(1) may be driven lastly in the descending order. Accordingly, two shift registers, e.g., shift registers SR(0) and SR(−1), must be provided after the shift register SR(1) in order to drive the unit circuits CD(2) and CD(1), respectively, and switches for each shift register of the intermediate positions.

When displaying an image of 16:9 aspect ratio with the descending configuration, the shift register SR(30) is driven with the shift register SR(31) or in response to a vertical synchronizing signal, and separate shift registers must be provided for driving the unit circuits CD(31) and CD(32).

According to the LCD 1 and LCD 1A, the signal line drive circuit (including the horizontal scan circuit 10 and signal line driver 11), scan line driver (including the shift registers SR and buffers BF), and capacitor line driver (including the unit circuits CD) are formed on an array substrate in the same process that forms the pixel transistors Q on the array substrate. This results in reducing the number of manufacturing processes of the LCD 1 and LCD 1A, the size of an IC that contains the signal line driver, scan line driver, and capacitor line driver, the number of parts such as terminals, and the dimensions of a peripheral area that must be prepared for mounting the IC.

What is claimed is:

1. A liquid crystal display comprising:

an array substrate having:

signal lines;

scan lines intersecting the signal lines;

pixel transistors arranged at intersections of the signal and scan lines, respectively, each pixel transistor becoming conductive when driven through a corresponding one of the scan lines;

pixel electrodes arranged at the intersections of the signal and scan lines, respectively, each pixel electrode being written with a video signal supplied through a corresponding one of the signal lines when a corresponding one of the pixel transistors becomes conductive; and capacitor lines formed along the scan lines, respectively, to provide an auxiliary capacitor for each of the pixel electrodes;

a liquid crystal layer;

a counter substrate opposing the array substrate with the liquid crystal layer interposed between them;

a signal line driver to supply video signals to the signal lines;

a scan line driver to sequentially drive the scan lines;

a capacitor line driver to sequentially drive the capacitor lines; and a display area to display an image by driving the scan lines and capacitor lines, the display area being dividable into a central area and top and bottom marginal areas that are on the top and bottom sides of the central area, the scan lines and capacitor lines in the top and bottom marginal areas being synchronously driven if the display area is divided into the central area and the top and bottom marginal areas, wherein the scan line driver includes shift registers that drive the scan lines, respectively;

the capacitor line driver includes unit circuits that drive the capacitor lines, respectively;

the unit circuits, except for certain of the unit circuits, are each driven by a predetermined one of the shift registers, the certain of the unit circuits being those that are lastly driven in the central area when the marginal areas are driven at first and then the central area is driven; and the scan line driver further includes shift registers that drive the certain of the unit circuits, the liquid crystal display further comprising:

an aspect ratio switch including a first terminal, a second terminal, and a third terminal, wherein the first terminal is connected to a signal line for operating a first additional shift register from a shift register for driving a last scan line among the scan lines in the top marginal area, the second terminal is connected to a signal line for supplying a vertical synchronizing signal, and the third terminal is connected to a signal line for operating a shift register for driving a first scan line among the scan lines in the central area, for switching a signal supply source for operating the shift registers from one to another, and the aspect ratio switch is set, in a normal case of displaying an image of 4:3 aspect ratio, to connect the first terminal and the third terminal so that the shift register for driving the last scan line among the scan lines in the top marginal area drives the shift register for driving the first scan line among the scan lines in the central area, and if the display receives a wide-view control signal to display an image of 16:9 aspect ratio, to connect the second terminal and the third terminal so that a vertical synchronizing signal drives the shift register for driving the first scan line among the scan lines in the central area.

2. The liquid crystal display of claim 1, wherein:

the capacitor line driver alternately applies two compensating voltages one at a time to each of the capacitor lines at predetermined timing in each field period.

3. The liquid crystal display of claim 2, wherein:

the marginal areas are driven before the central area by alternating the polarities of the scan lines from line to line; and the liquid crystal display further comprises a unit for differing the polarity of a scan line that is lastly driven in the central area from the polarity of a line that is firstly driven in the marginal areas and is adjacent to the line lastly driven in the central area.

4. The liquid crystal display of claim 2, wherein:

the signal line driver, scan line driver, and capacitor line driver are formed on the array substrate in the same process that forms the pixel transistors on the array substrate.

5. The liquid crystal display of claim 1, wherein:

the marginal areas are driven before the central area by alternating the polarities of the scan lines from line to line; and the liquid crystal display further comprises a unit for differing the polarity of a scan line that is lastly driven in the central area from the polarity of a line that is firstly driven in the marginal areas and is adjacent to the line lastly driven in the central area.

6. The liquid crystal display of claim 5, wherein:

the signal line driver, scan line driver, and capacitor line driver are formed on the array substrate in the same process that forms the pixel transistors on the array substrate.

7. The liquid crystal display of claim 1, wherein:

the signal line driver, scan line driver, and capacitor line driver are formed on the array substrate in the same process that forms the pixel transistors on the array substrate.

* * * * *